United States Patent [19]

Takeda et al.

[11] 4,400,418

[45] Aug. 23, 1983

[54] CYLINDRICAL COVERING FABRIC FOR A DAMPING FORM ROLLER OF AN OFFSET PRINTING MACHINE

[75] Inventors: Hirofumi Takeda, Osaka; Hirobumi Suzuki, Kawasaki, both of Japan

[73] Assignee: M.M.T. Inc., Osaka, Japan

[21] Appl. No.: 386,191

[22] Filed: Jun. 7, 1982

[30] Foreign Application Priority Data

Aug. 10, 1982 [JP] Japan ..... 56/123990

[51] Int. Cl.[3] ..... B21B 31/08

[52] U.S. Cl. ..... 428/36; 29/120; 29/131; 29/132; 66/194; 101/148; 428/85; 428/95; 428/222; 428/227; 428/229; 428/253; 428/257; 428/371

[58] Field of Search ..... 428/36, 64, 68, 85, 428/95, 222, 227, 229, 257, 253, 371, 377, 909; 66/194; 101/148; 29/120, 131, 132

[56] References Cited

U.S. PATENT DOCUMENTS

| | | | |
|---|---|---|---|
| 3,229,351 | 1/1966 | Peterson et al. | 101/148 |
| 3,926,701 | 12/1975 | Nishiwaka | 428/95 |
| 4,298,643 | 11/1981 | Miyagawa et al. | 428/229 |

FOREIGN PATENT DOCUMENTS

| | | | |
|---|---|---|---|
| 1213866 | 4/1966 | Fed. Rep. of Germany | 101/148 |

*Primary Examiner*—James J. Bell
*Attorney, Agent, or Firm*—Albert L. Jeffers

[57] ABSTRACT

A cylindrical covering fabric for a damping form roller of an offset printing machine is manufactured by weaving, as ground yarn, yarns composed of polyurethane fibers drafted to at least twice of free length, water-soluble fibers and water-insoluble fibers coiling around the above-mentioned polyurethane fiber and water-soluble fiber and, as pile yarn, hydrophilic fibers. The covering fabric is firmly mounted on a damping form roller by immersing the roller covered by the fabric in water to remove the water-soluble fibers from the ground yarns, followed by shrinking of the polyurethane fibers.

4 Claims, No Drawings

CYLINDRICAL COVERING FABRIC FOR A DAMPING FORM ROLLER OF AN OFFSET PRINTING MACHINE

BACKGROUND OF THE INVENTION

The present invention relates to an improved covering fabric for a damping form roller of an offset printing machine. More particularly, the invention relates to the covering fabric in which drafted polyurethane fibers fixed to water-soluble fibers are used as ground yarn.

In offset printing it is necessary to wet the surface of a printing plate with water before the application of oil-based printing inks. For such a purpose, a damping form roller covered by fabric has been used. Therefore the covering fabric must have a sufficient water absorbing capacity and furthermore must be firmly mounted on the damping form roller. Heretofore there is conventionally used a covering fabric which is manufactured by knitting fibers into a cylindrical form having piles on the outer surface, where the piles may be cut or uncut piles. A non-woven cylindrical covering sleeve consisting of hydrophilic materials has also been used. In order to facilitate the covering operation and to mount firmly on the roller, the above-mentioned covering fabric or sleeve can be manufactured having a diameter of larger than that of the roller and, after covering of the roller, the covering fabric or sleeve is shrunk, where lightly heat-treated and non-acetalized multifilament polyvinyl alcohol fibers are used as a water-shrinkable ground yarn of the covering fabric (U.S. Pat. No. 3,926,701) and polyvinyl alcohol fibers, rayon fibers and polypyrrolidone fibers are used as a water-shrinkable substrate of the covering sleeve (U.S. Pat. No. 3,229,351). Such covering fabric and sleeve are firmly mounted on the roller at the starting of use, however, it happens that the ground yarns and the substrate become gradually weak as these are always in wet state and, consequently the covering fabric or sleeve is twisted or bulged. These disadvantages become more remarkable at a high speed offset printing.

In order to avoid such disadvantages, there is proposed a covering fabric using, as the ground yarn, polyurethane fibers as free length coiled by cotton fibers. Such a covering fabric is manufactured having a diameter of smaller than that of the roller. In mounting this covering fabric, it is stretched and then fitted on the roller by shrinkage of polyurethane fibers. This covering fabric is, however, poor in contractibility and it tends to slip on the roller. Thus, this covering fabric must have a diameter of very smaller than that of the roller in order to mount firmly on the roller. But, it is difficult to mount such a small covering fabric on the roller.

SUMMARY OF THE INVENTION

The object of the present invention is to provide an improved covering fabric for a damping form roller of an offset printing machine, which can be easily mounted on the roller and remains firmly mounted even at high speed rotation of the roller.

According to the present invention, there is provided a cylindrical covering fabric for a damping form roller of an offset printing machine, which comprises ground yarns and hydrophilic pile yarns, said ground yarns being composed of polyurethane fibers drafted to at least twice of free length, water-soluble fibers and water-insoluble fibers coiling around said polyurethane fibers and water soluble fibers.

DETAILED DESCRIPION OF THE INVENTION

The ground yarn in the present invention is composed of polyurethane fibers drafted to at least twice, preferably 2 to 5 times, of free length, water-soluble fibers entangled with the above-mentioned polyurethane fibers, and water-insoluble fibers or filaments coiling around the above-mentioned polyurethane fibers and water-soluble fibers.

In the ground yarn, polyurethane fibers are drafted and fixed to the water-soluble fibers by coiling with the water-insoluble fibers. Polyurethane fibers used are of, for example, 20 to 70 denier. The water-soluble fibers are water-soluble polyvinyl alcohol fibers. They are of, for example, 90 to 150 denier and may consist of, for example, 1.5 denier×60 filaments or 10 denier×15 filaments. The water-insoluble fibers are, for example, polyester fibers or water-insoluble polyvinyl alcohol fibers. They are of, for example, 70 to 150 denier and may consist of, for example, 1 denier×75 filaments or 1 denier×150 filaments. Kinds of these fibers used in the ground yarn are conveniently selected according to the condition where the covering fabric is used.

The pile yarn in the present invention is composed of hydrophilic fibers used in the conventional covering fabric. The hydrophilic fibers include cotton fibers, hemp fibers, rayon fibers, etc. Preferably the hydrophilic fibers are water-insoluble polyvinyl alcohol fibers which are prepared by subjecting polyvinyl alcohol to a high temperature treatment, optionally followed by formalization. The pile yarn may be composed of the above-mentioned water-insoluble polyvinyl alcohol fibers twisted with rayon fibers. The rayon fiber includes polynosic rayon fiber, hollow rayon fiber, etc. Such rayon fibers are superior in wear resisting property and have a better tensile strength at wet state as compared to cotton fibers. Therefore the covering fabric using the above-mentioned twisted pile yarn has a sufficient water absorbing capacity due to polyvinyl alcohol fibers and has sufficient wear resisting property and tensile strength due to rayon fibers. The proportion of rayon fibers in the pile yarn can be 5 to 95%. The pile yarn is, for example, of about 1000 to 1200 denier.

In the covering fabric of the present invention, the ground yarns have been woven together with hydrophilic pile yarns into a cylindrical shape of a diameter of slightly larger than that of the roller. The covering fabric of the present invention can be easily mounted firmly on the roller as following. The water-soluble fibers are dissolved to remove out of the ground yarns by immersing the roller covered by the fabric, polyurethane fibers are released from the drafted state to shrink and thus the covering fabric is firmly mounted on the roller. Since the shrunk ground yarn does not include the water-soluble fibers, the covering fabric remains firmly mounted on the roller even at high speed rotation of the roller and wet state.

The present invention is described with reference to the following non-limitative Examples.

EXAMPLE 1

A cylindrical fabric having piles was manufactured by means of a circular knitting machine of 3½ inches in diameter, employing 86 needles. As the ground yarn three yarns were used, each of which was composed of 20 denier polyurethane fibers (Spandex) drafted to 3.7 times of the free length, 90 denier water-soluble polyvinyl alcohol fibers entangled with the above-mentioned polyurethane fibers and 75 denier polyester fibers (Woollie polyester) coiling around the above-mentioned polyurethane fibers and polyvinyl alcohol fibers at 800 T/M. As the pile yarn two #20/2 polynosic rayon yarns were used.

A damping form roller having the same diameter as the covering fabric was covered by the fabric, immersed in water of 30° C. for 5 minutes to dissolve the polyvinyl alcohol fibers and to remove them out of the ground yarns. The covering fabric was firmly mounted on the roller and remained as such even at high speed printing.

The covering fabric prior to covering was shrunk by 15.7% when immersed in water of 30° C.

EXAMPLES 2 to 11

Cylindrical fabrics having piles were prepared as the same manner as in Example 1 except that the materials of ground yarns and weaving conditions are changed as shown in Table. On each covering fabric a shrinking percentage when immersed in water of 30° C. for 7 minutes was determined and a usefulness was decided based on the shrinking percentage. Results are shown in Table.

| | Materials of ground yarn | | | Weaving Condition | | | |
|---|---|---|---|---|---|---|---|
| Example No. | Polyurethane fiber | Water-soluble fiber (Polyvinyl alcohol) | Water-insoluble fiber (Woollie polyester) | Number of ground yarn | Number of needle | Shrinking percentage | Usefulness** |
| 2 | 20 d | 90 d | 70 d | 2 | 86 | 15.1 | A |
| 3 | 40 | 90 | 150 | 2 | 86 | 13.6 | A |
| 4 | 20 | 90 | 70 | 2 | 98 | 15.1 | A |
| 5 | 40 | 90 | 70 | 2 | 98 | 12.9 | A |
| 6 | 40 | 90 | 70* | 2 | 86 | 9.9 | A |
| 7 | 70 | 90 | 70 | 2 | 98 | 9.8 | A |
| 8 | 40 | 90 | 70 | 3 | 98 | 10.0 | A |
| 9 | 70 | 90 | 70* | 1 | 98 | 8.7 | B |
| 10 | 70 | 90 | 70* | 1 | 86 | 8.9 | B |
| 11 | 40 | 90 | 70* | 2 | 98 | 8.3 | B |

*#20 cotton fiber is added.
**A: Excellent as the covering fabric.
B: Good as the covering fabric.

What is claimed is:

1. A cylindrical covering fabric for a damping form roller of an offset printing machine, which comprises ground yarns and hydrophilic pile yarns woven together, said ground yarn being composed of polyurethane fibers drawn to at least twice their free length, water-soluble fibers and water-insoluble fibers coiling around said polyurethane fibers and water-soluble fibers.

2. A cylindrical covering fabric of claim 1, in which said water-soluble fibers are water-soluble polyvinyl alcohol fibers.

3. A cylindrical covering fabric of claim 1, in which said water-insoluble fibers are polyester fibers or water-insoluble polyvinyl alcohol fibers.

4. A cylindrical covering fabric of claim 1, in which polyurethane fibers have been drawn to 2 to 5 times their free length.

* * * * *